United States Patent [19]

Fulchiron et al.

[11] 4,348,936

[45] Sep. 14, 1982

[54] SAFETY RELEASE DEVICE FOR A LOAD SUSPENDED FROM AN AIRCRAFT FOR TRANSPORT AND CHARGE EQUIPPED WITH SUCH A DEVICE

[75] Inventors: Noël Fulchiron; Bernard Naillon, both of Paris, France

[73] Assignee: "Thomson-Brandt", Paris, France

[21] Appl. No.: 151,668

[22] Filed: May 20, 1980

[30] Foreign Application Priority Data

May 23, 1979 [FR] France ..... 79 13200

[51] Int. Cl.[3] ..... B64D 1/04

[52] U.S. Cl. ..... 89/1.5 D

[58] Field of Search ..... 89/1.5 D, 1.5 E, 1.5 F, 89/1.5 G, 1.5 H, 1.5 R, 1.812; 244/137 R; 294/83 AA, 83 AE

[56] References Cited

U.S. PATENT DOCUMENTS 3,625,106 12/1971 Russo et al. ..... 89/1.5 D 3,956,964 5/1976 McGuire ..... 89/1.5 D

*Primary Examiner*—David H. Brown

*Attorney, Agent, or Firm*—Oblon, Fisher, Spivak, McClelland & Maier

[57] ABSTRACT

The invention concerns a safety release device for a charge suspended from an aircraft. A so-called bus bar occupies two positions, the first called the "safety" position, in which the unlocking of any locking element connected to the charge is prevented, even if orders to this effect were given, and the second called the "cocked" position, which, in contrast, permits orders to be carried out once given. A system for suspending the charge cooperates with said bar, said system comprising a given number of means acting in such a way that, as long as the lug of the carrier vehicle is connected with the suspension system, displacement of said bar is impossible. Such a suspension system consists of a ring capable of undergoing a movement, particularly rotation, translation in a vertical plane, or rocking, only when the lug is no longer present in the opening of the ring, said movement freeing a means integral with the ring which previously impeded the movement of the bar. The invention is applied particularly to the transportation and dropping of military charges.

5 Claims, 4 Drawing Figures

SAFETY RELEASE DEVICE FOR A LOAD SUSPENDED FROM AN AIRCRAFT FOR TRANSPORT AND CHARGE EQUIPPED WITH SUCH A DEVICE

BACKGROUND OF THE INVENTION

Field of the Invention

The invention concerns a safety release device for a charge designed to be suspended from an aircraft for transport. It also concerns any charge equipped with such a device.

Description of the Prior Art

When a charge is suspended from an aircraft for transport to its drop site, it is important that certain safety regulations be observed. For example, in the case of a military charge, the firing order must not be able to occur until after separation of the charge from the carrier.

SUMMARY OF THE INVENTION

The object of the present invention is to solve this problem. The invention concerns a combination of means working together in such a way that unlocking of the devices controlling the use of the charge being carried cannot occur unless the charge suspension system has indeed been release from the carrier. More particularly, the invention concerns a safety release device for at least one charge suspended from the carrier, such as an aircraft, characterized in that it comprises a bus bar capable of occupying a position called the "safety" position, in which any unlocking of the charge is prevented, even if orders to this effect were given, and a position called the "cocked" position, in which such orders may be carried out; and a system for hanging the charge on the lug of the carrier, said system being equipped with means cooperating with the bus bar in such a way that, as long as the lug is not separated from the suspension element, translation of the bus bar from the "safety" position to the "cocked" position is impossible.

BRIEF DESCRIPTION OF THE DRAWINGS

The invention will be better understood with the help of the following explanations and the attached figures, in which.

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

For greater ease in comprehension, identical elements bear the same numerical references in all the figures.

Figure 1:
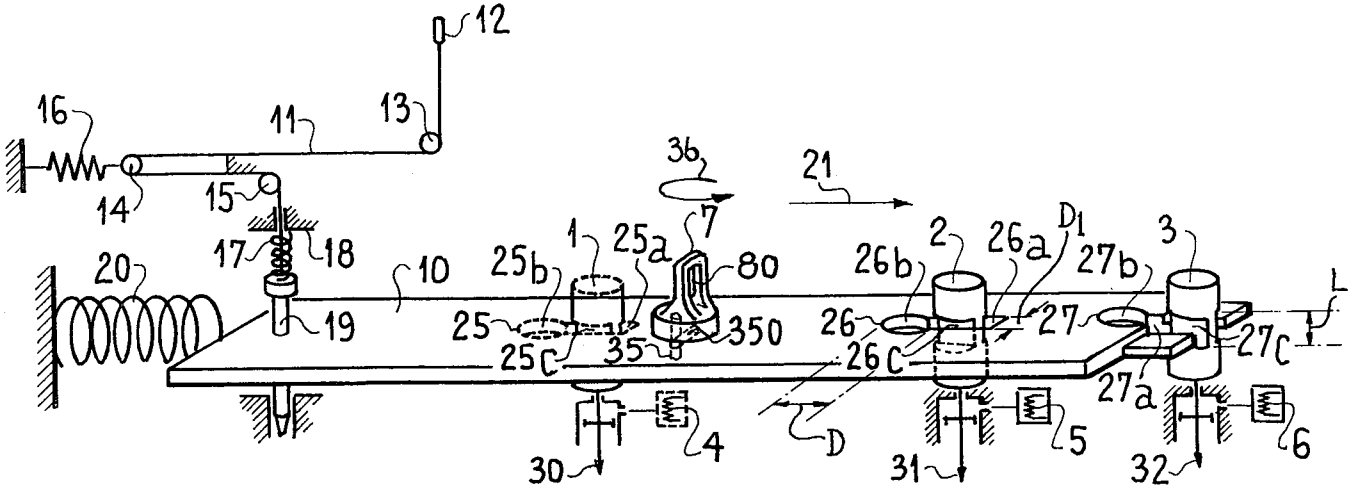
FIG. 1 represents schematically how the system for hanging a charge on a carrier cooperates with a device ensuring placement into unlockable position of means which lock the essential elements the operation of which must never occur unless separation of the charge from the carrier is complete.

FIG. 1 shows bolts 1, 2, 3 (for example, three in number) and associated control means 4, 5, 6 designed to unlock them, thus releasing the element(s) contained in a container (not shown in the figure) which said means had been locking. This may involve military charges, elementary tanks, or modules, designed to be released simultaneously or in succession, i.e., on command. The assembly of these elements and their control accessories is suspended from the carrier (not shown) by means of a hanging system. This involves, for example, at least one ring 7, integral with the body containing the basic modules, via opening 80 through which penetrates the lug of the carrying means (not visible on figure), which is itself integral with the carrier. Separation takes place when the lug is voluntarily disconnected from the ring, thus releasing the ring-lug link.

In accordance with the invention, a device 10, denominated "bus bar" in the following description and having the nature of a general mechanical control element, is provided. Said bus bar 10 may occupy two positions: the first, so-called "safety" position (which is shown in the figure) and a second, so-called "cocked" position. Displacement of said bar may be controlled by any known means. For example, as represented schematically in FIG. 1, there may be a releasable base safety cable 11, which is pulled in traction at one of its ends 12. By a set of pulleys 13, 14, and 15, and spring 16, it acts upon spring 17, which is compressed against stop 18, thus releasing a movable lock pin 19, which is retracted. Bus bar 10, previously held in safety position by said pin 19, is thus freed and, under the effect of return spring 20, it moves back, moving in a specified direction (e.g., the direction of arow 21), toward the "cocked" position.

Openings 25, 26 and 27 are provided in said bus bar. A bolt-bus bar combination is described below by way of example. Said openings, designed to cooperate with the bolts, comprise two parts: an open cavity having an essentially circular-shaped section of diameter D and a second open cavity having an essentially rectangular section of width $D_1$, much smaller than D. The bolts, in the example described, comprise, for example, two parts: the first, having a cylindrical cross-section and a diameter which is very slightly smaller than D, is able to move within the first cavity and even be unbolted; the second has a section which is narrowed over a length L which is slightly greater than the thickness of the bus bar and is able to move within the second cavity only over a short travel corresponding approximately to said length L.

In the safety position (that of the figure), the bolts, even if they received the unlocking order, are blocked, and the operation cannot take place. On the other hand, when bus bar 10 is in "cocked" position, the same bolts are positioned in the first cavity **25*b*, 26*b* and 27*b* of the housings and are then in unlockable position and ready to undergo the effects of unlocking means 4, 5, 6 so as to be retracted, as shown respectively by arrows 30, 31, 32**. The unlocking orders are a function of the chosen sequence of operations, being either simultaneous or staggered.

In accordance with the invention, by moving from the "safety" position to the "cocked" position, the bus bar pushes, by means of another opening 350, against a stud 35, which causes ring 7 to rotate (see direction of arrow 36). If said ring 7 is still connected to the lug of the carrier, the lug-ring connection resists this rotation and therefore the displacement of bus bar 10 from the "safety" to the "cocked" position. Consequently, the separation of the ring from the lug of the carrier must be complete in order for said displacement to take place and for the unlocking of bolts 1, 2, and 3 to be possible. This constitutes an extremely reliable safety system and is one of the principal characteristics of the invention.

Figure 2:
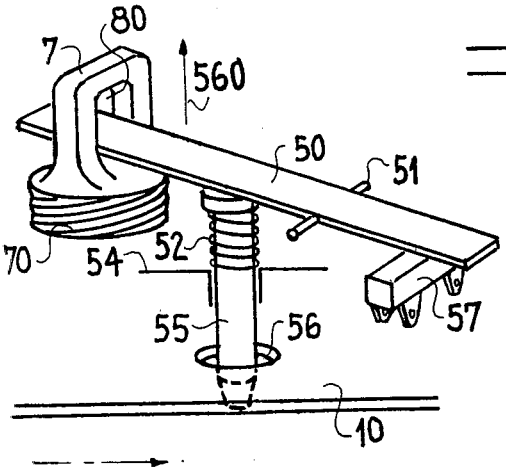

FIG. 2 is a schematic representation of a variant of the combination of a bus bar 10 and ring 7', cooperating so as to obtain the previously stated result, i.e., the possible displacement of the bus bar only when the carrier lug is well separated from the ring. In FIG. 2 are ring 7' with threading 70, designed to fasten it to the container which is to be transported and dropped. Said ring 7' is connected, in this variant, to bus bar 10 of the previously described type, in the manner described below. The first end of a lever arm or blade 50 penetrates opening 80 of ring 7'. Said arm is articulated about axis of articulation 51. Its function, when pressure is applied to its first end, is to contact a lock pin 55 which passes through the bus bar within another housing provided for this purpose, and prevents any displacement of said bar from the safety to the cocked position. A return spring 52, which rests against a stop 54, tends to raise pin 55. This pressure is exerted on arm 50 as long as the lug (not shown in the figure) is inserted in ring 7. As soon as this lug is disconnected from the ring, said pressure disappears, and pin 55 drives lever arm 50, which rises in the direction of arrow 560. Pin 55 leaves its housing 56 and thus releases the bus bar, displacement of which may then be carried out by any means, e.g., that described using FIG. 1. A detection device 57 for detecting the position of arm 50 may also be provided, said device possibly controlling an electric circuit.

Figure 3:
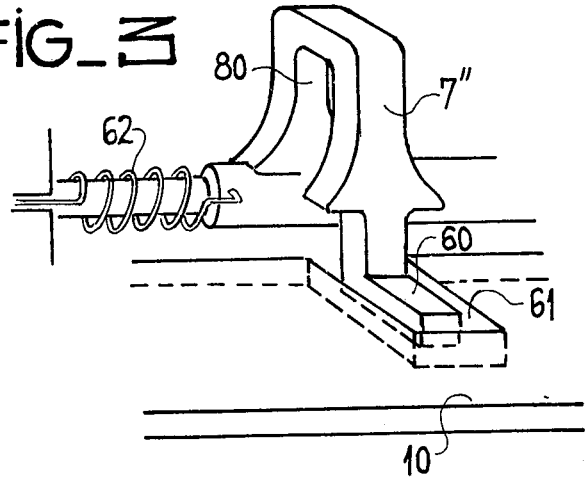
FIGS. 2, 3, and 4 show schematically some variants of the combination of means represented in FIG. 1.

FIG. 3 is a schematic representation of another variant of a combination conforming to the invention. In this case, the ring does not turn as in FIG. 1, but rather rocks. It is held in place during the entire transportation phase by means of a stub 60, which sits in a housing 61 provided for this purpose in bus bar 10, impeding the movement of the latter. Said stub 60 presses upward during transport against the structure of the container (not shown). It is held there as long as the carrier lug, by virtue of its presence within the ring, prevents torsion spring 62 from taking effect. As soon as the lug is disconnected from the ring, under the effect of this very torsion spring 62, ring 7'' tips, lowering stub 60 in a travel greater than the thickness of bus bar 10 and, at the same time, enabling the translational movement of the latter from the "safety" position to the "cocked" position.

Figure 4:
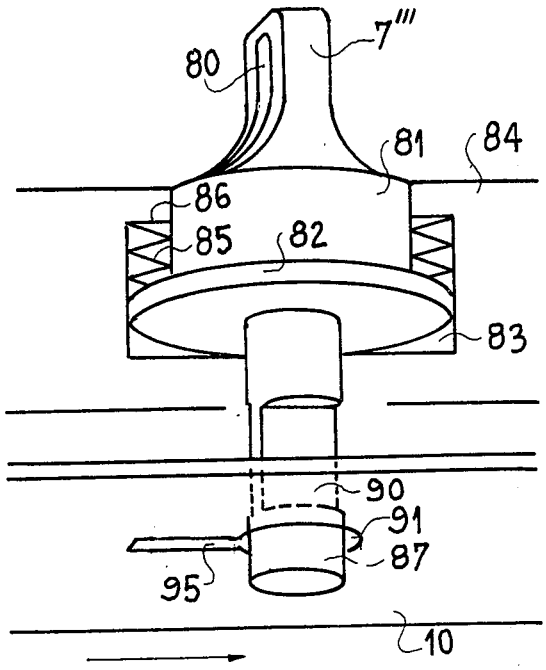

FIG. 4 represents schematically a variant in which the movement of the ring is vertical. Ring 7''' comprises, in addition to opening 80 intended to receive the carrier lug, a cylindrical portion 81 comprising a shoulder 82. Said cylindrical portion 81 is contained in a housing 83 provided within the casing 84 which is to support the ring. A spring 85 is provided between said shoulder 82 and one of the surfaces 86 of housing 83. The ring further comprises a second portion 87 designed to penetrate bus bar 10. Said second cylindrical portion comprises a portion 90 which is narrowed over a specified length. When the ring is suspended from the carrier lug, spring 85 is compressed and cylindrical portion 87 is in circular-sectioned cavity 91, provided for this purpose in bus bar 10. The translational movement of the bus bar is impeded. On the other hand, when the lug is disconnected from the ring, spring 85 expands and cylindrical portion 87 drops into the bus bar until narrowed portion 90 is opposite slot 95. Movement of the bus bar may then take place.

The entire preceding description refers to the case of a charge actually suspended from a carrier prior to being dropped. However, before such transport, charges are most often warehoused and it is desirable to provide a ground safety device which will substitute more or less for the carrier lug. In the case of the rotating ring (FIG. 1), a square sectioned piece is, for example, inserted into the opening of the ring(s), and is removed upon hanging onto the carrier. Other types of ground safety devices may also be used. These do not fall within the scope of the present invention. They are removed as soon as the charge is hung onto the carrier.

The applications of a bus bar cooperating with a ring equipped with means capable of blocking or enabling the translational movement of said bus bar are numerous. Such a combination is applicable whenever locking means must not be able to be unlocked as long as a given operation has not taken place, e.g., separation of a ring and a lug connecting it to a carrier. This problem is found especially in applications such as transportation of military charge.

What is claimed as new and desired to be secured by Letters Patent of the United States is:

1. A safety device for a munition suspended beneath an aircraft, said safety device comprising:

a sliding bar movable between a first position and a second position;

first blocking means for locking said bar in said first position;

cable release means connected between said aircraft and said first blocking means for actuating the release of said first blocking means;

at least one suspending ring engageable with a hook integral with said aircraft;

second blocking means mechanically connected to said at least one ring for locking said bar in said first position when said at least one ring is engaged with said hook;

at least two apertures in said sliding bar, each of said apertures having first and second cross sections;

a fuse lock engageable with each of said apertures, each said fuse lock including a first rectangular cross section portion engageable with said first cross section of one of said apertures when said sliding bar is in said first position for maintaining said fuse lock in a safety position and a second circular cross section engageable with said second cross section of said one of said apertures when said sliding bar is in said second position for releasing said fuse lock into an armed position, whereby said fuse locks are released into an armed position only when said release means is actuated and said at least one ring is disengaged from said hook.

2. A device according to claim 1 wherein said second blocking means for said sliding bar comprises a stud integral with said at least one ring, said stud being located in an auxiliary aperture formed in the sliding bar, and wherein each said at least one ring is rotatably movable about an axis perpendicular to the direction of displacement of said bar.

3. The device of claim 1 wherein said second blocking means comprises:

an auxiliary aperture in said sliding bar, said auxiliary aperture having a first circular cross section and a second rectangular cross section;

means permitting said at least one ring to move between a first position wherein said ring is engaged with said hook, and a second position;

means biasing said ring into said second position; and a cylindrical extension fixed to each said ring, each said cylindrical extension including a first circular cross section portion engageable with said first circular cross section of said auxiliary aperture when said ring is in said first position, and a second rectangular cross section portion engageable with said second rectangular cross section of said auxiliary aperture when said ring is in said second position.

4. The device of claim 1, wherein said second blocking means comprises a stub integral with said at least one ring, said stub being located in an auxiliary socket formed in said sliding bar, wherein said at least one ring is rotatably movable by the action of a spring about an axis parallel to the direction of movement of the sliding bar.

5. The device of claim 1 wherein said second blocking means comprises:

said at least one ring being fixed to said munition; and a pin movable between a first position in engagement with an auxiliary aperture of said sliding bar for locking said sliding bar in said first position thereof, and a second position disengaged with said auxiliary aperture for unlocking said sliding bar, said pin further engaging the aperture of said one ring when said ring is engaged with said hook for maintaining said pin in said first position thereof.

* * * * *